United States Patent [19]

Farrar et al.

[11] Patent Number: 4,781,049

[45] Date of Patent: Nov. 1, 1988

[54] APPARATUS FOR CREATING A FLORENTINE PATTERN ON A GOLD STRIP

[75] Inventors: William P. Farrar; John L. Tomsik, both of Rapid City, S. Dak.

[73] Assignee: Coleman-Frizzell, Inc., Rapid City, S. Dak.

[21] Appl. No.: 4,629

[22] Filed: Jan. 20, 1987

[51] Int. Cl.[4] ..... B21D 73/00

[52] U.S. Cl. ..... 72/220; 72/703; 29/160.6; 51/38; 409/136; 409/157; 409/169; 409/190

[58] Field of Search ..... 29/160.6; 409/172, 157, 409/169, 190, 204, 136; 51/38, 39; 72/184, 189, 88, 90, 220, 703

[56] References Cited

U.S. PATENT DOCUMENTS

| | | | |
|---|---|---|---|
| 725,142 | 4/1903 | Robinson | 51/38 |
| 2,071,619 | 2/1937 | Fiegel | 409/157 |
| 2,327,531 | 8/1943 | Koch | 409/157 |
| 3,494,253 | 2/1970 | Hood et al. | 409/157 |
| 3,708,817 | 1/1973 | Rhine et al. | 51/38 |
| 4,047,470 | 9/1977 | Lorenz et al. | 409/157 |

FOREIGN PATENT DOCUMENTS

| | | | |
|---|---|---|---|
| 602315 | 4/1978 | U.S.S.R. | 409/204 |

*Primary Examiner*—P. W. Echols

*Attorney, Agent, or Firm*—Zarley, McKee, Thomte, Voorhees & Sease

[57] ABSTRACT

An apparatus for creating a florentine finish on a gold strip comprising a table-like support including spaced-apart driven friction wheels which move the gold strip across the upper surface of the support beneath a rotating and oscillating cutter wheel which grinds or cuts the upper surface of the gold strip as it passes therebeneath.

5 Claims, 4 Drawing Sheets

APPARATUS FOR CREATING A FLORENTINE PATTERN ON A GOLD STRIP

BACKGROUND OF THE INVENTION

A certain design of gold jewelry known as Black Hills Gold or Black Hills Gold Jewelry is sold throughout the United States and is manufactured in the Black Hills area of South Dakota. Black Hills Gold Jewelry normally consists of a plurality of gold leaves which are secured together in a predetermined pattern on rings, pendants, earrings, etc.

In the normal manufacture of the jewelry, the individual leaves are stamped or punched out of a rectangular strip of gold material. Once the leaves have been stamped from the gold strip, they are assembled on a soldering board and a gold solder paste is applied thereto. Heat is then applied to melt the gold solder paste thereby brazing the parts together. Oxidation does occur with this process and the same is removed by bombing and tumbling. After bombing and tumbling, the jewelry is gold plated and is then sometimes adhered with hot wax to a wooden dowel. This is done to hold the jewelry in place so it can be hand-florentined and hand-engraved.

The individual leaves are hand-florentined by manually placing the leaf into engagement with a "wriggle" machine employing a tool bit which moves in a rocking motion to impart a mat or florentine finish thereto. The florentine process brings out or highlights the red or green color and provides contrast for the bright or vein cuts which will subsequently be created in the leaf. After the individual leaves have been hand-florentined, leaf veins or bright cuts are then hand-engraved therein. The vein cuts are created in the individual leaves by employing a highly polished and sharp tool bit to cut out or engrave grooves in the jewelry leaves with the grooves resembling leaf veins. The above described process is extremely time-consuming and is labor-intensive.

It is therefore a principal object of the invention to provide a machine which imparts a florentine pattern on a gold strip.

A further object of the invention is to provide a machine which automatically applies a florentine pattern on a gold strip by bringing the strip into contact with a serrated, carbide cutting wheel.

Still another object of the invention is to provide a means for creating a florentine pattern on a gold strip from which leaves will be subsequently punched.

These and other objects will be apparent to those skilled in the art.

SUMMARY OF THE INVENTION

An apparatus is described which creates a uniform-depth florentine or mat finish on a gold strip. The apparatus comprises a support table having means for conveying the gold strip beneath a rotating and oscillating cutter wheel. The rotating and oscillating cutter wheel etches or grinds a florentine surface on the upper surface of the gold strip as the gold strip is passed therebeneath. The machine of this invention eliminates the need for hand-florentining gold leaves which are used in Black Hills Gold jewelry.

DESCRIPTION OF THE PREFERRED EMBODIMENT

Figure 1:
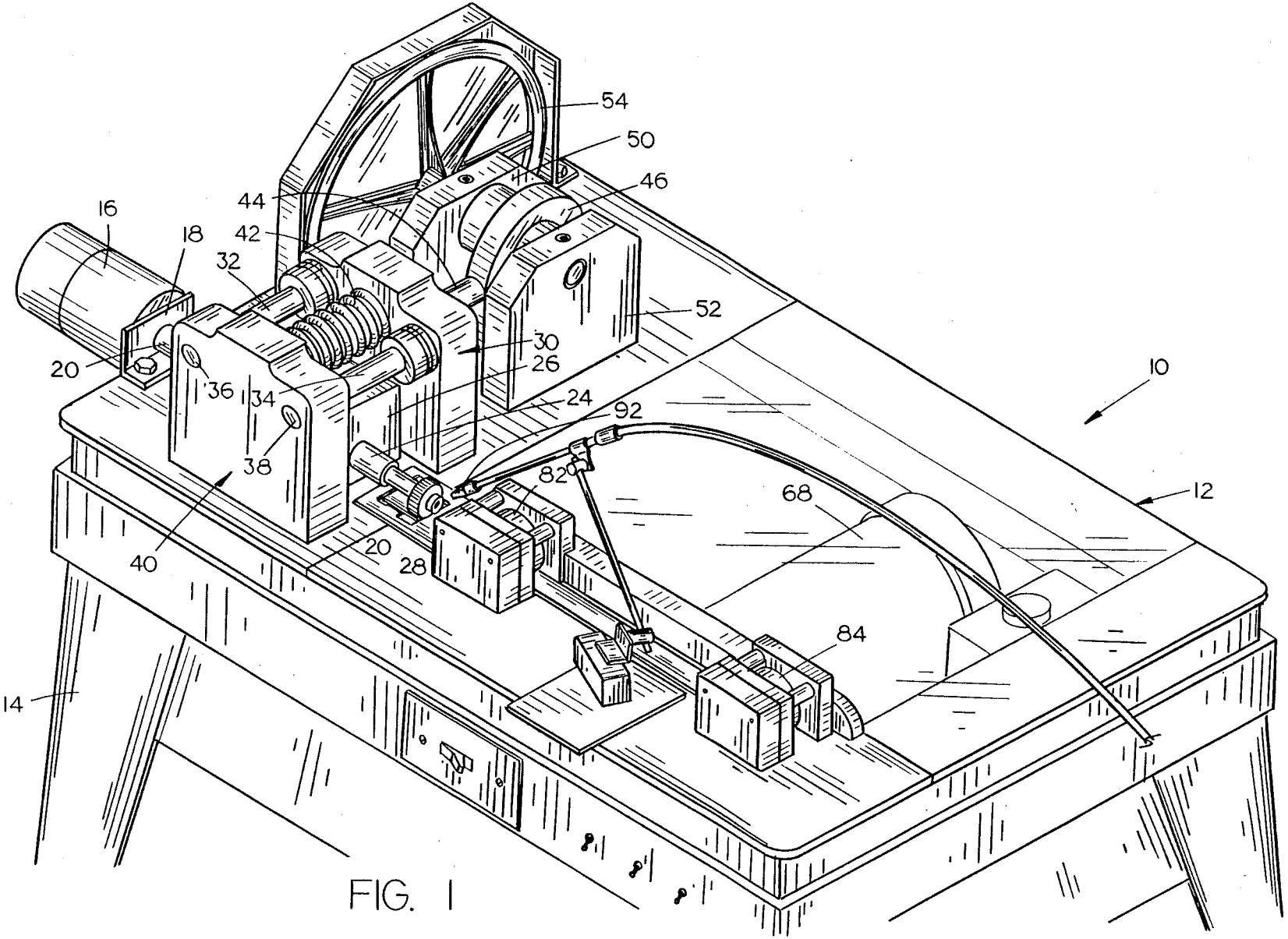
FIG. 1 is a partial top perspective view of the apparatus of this invention.
Figure 2:
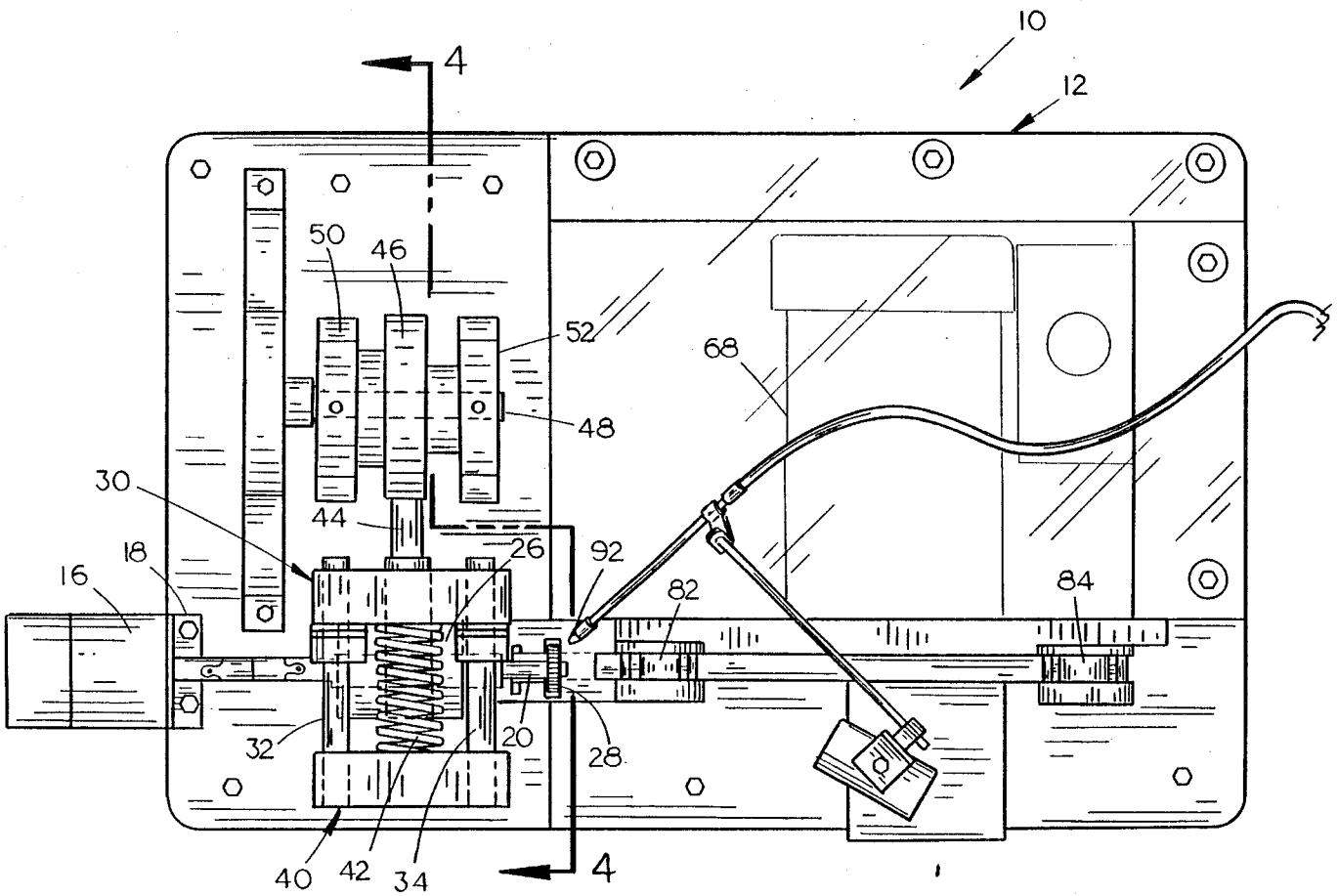
FIG. 2 is a top elevational view of the apparatus of this invention.

The apparatus or machine of this invention is referred to generally by the reference numeral 10. Machine 10 includes a table portion 12 having a plurality of legs 14 extending downwardly therefrom for supporting the same. Electric motor 16 is mounted at one end of table portion 12 by bracket 18 and is connected to a source of electrical power. Drive shaft 20 extends horizontally from motor 16 and includes one or more U-joints 22 mounted therein. Shaft 20 is rotatably mounted in a sleeve 24 which is mounted in block 26. A serrated, carbide cutting wheel 28 is mounted on the end of shaft 20 in rotation therewith as best seen in FIG. 1.

Block 26 is secured at one side thereof to support member 30 which has a pair of horizontally disposed dowels or pins 32 and 34 extending laterally from the upper end thereof. The ends of dowels 32 and 34 are slidably received in openings 36 and 38 formed in support member 40 which is rigidly secured to the upper surface of table portion 12. Spring 42 is positioned between support members 30 and 40 to yieldably urge support member 30 away from support member 40. Stub shaft 44 extends horizontally from support member 30 and has its outer end in engagement with wheel 46 which is eccentrically mounted on shaft 48 rotatably mounted in and extending between support members 50 and 52 which are mounted on the upper surface of table portion 12. Pulley 54 is mounted on one end of shaft 48 and has belt 56 extending therearound which also extends around one sheave of a multiple sheave pulley 58. Belt 60 extends around another sheave of pulley 58 and extends around pulley 62 mounted on shaft 64 of motor 66.

Figure 3:
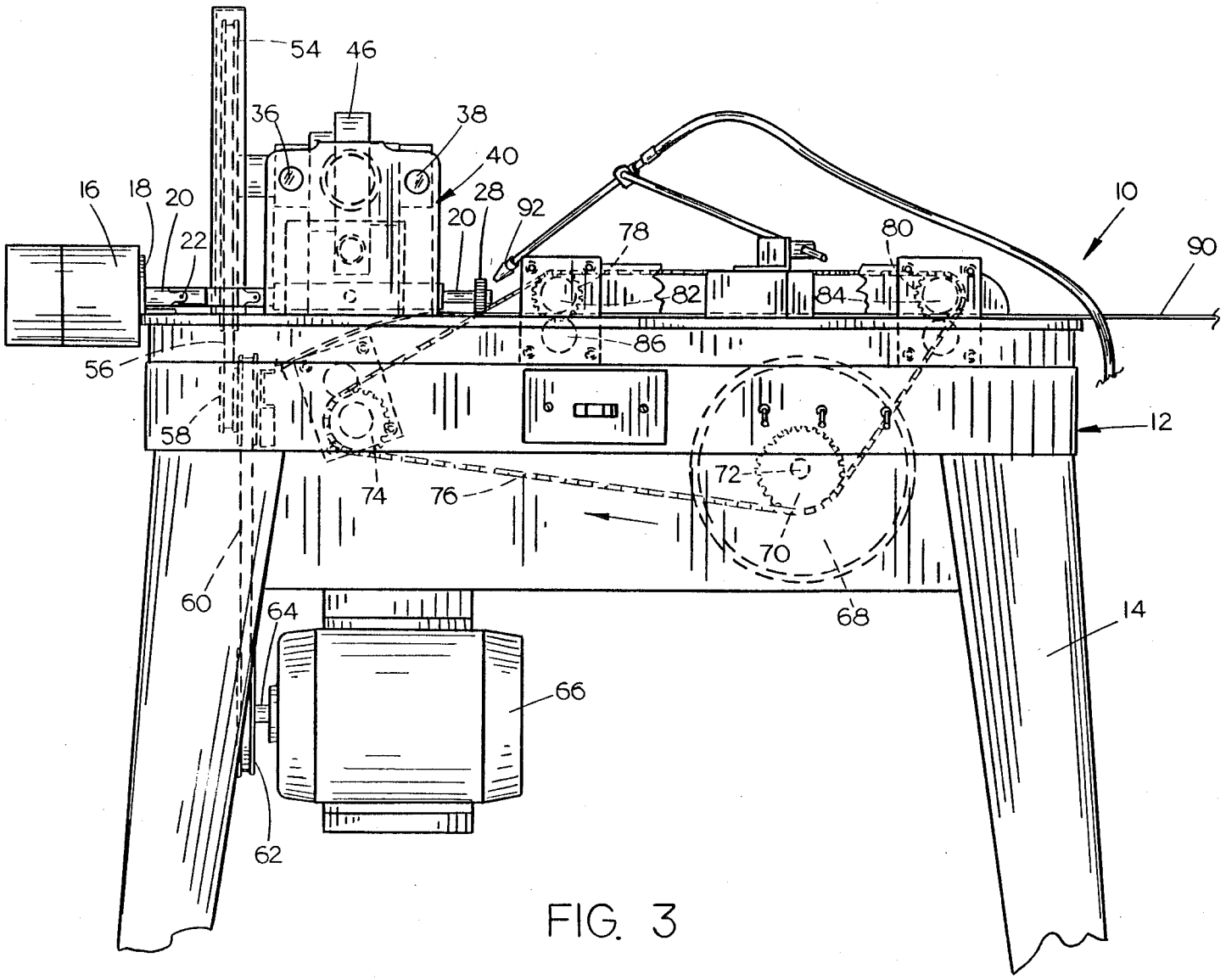
FIG. 3 is a side elevational view of the apparatus of this invention.

Motor 68 is provided on machine 10 and base table portion 12 and has sprocket 70 mounted on drive shaft 72. Sprocket 74 is rotatably mounted beneath table portion 12 as seen in FIG. 3 and receives chain extending therearound. Chain 76 extends around sprockets 74 and 70 and extends around sprockets 78 and 80 which are rotatably mounted on table portion 12 in a horizontally spaced-apart condition. Friction wheels 82 and 84 are operatively connected to sprockets 78 and 80 for rotation therewith. Friction wheels 86 and 88 are also rotatably mounted on table portion 12 below friction wheels 78 and 80 as seen in FIG. 3. The gold strip 90 is designed to pass between friction wheels 80–88 and 78–86 with the friction wheels engaging the upper and lower surfaces of the strip 90 to propel the strip 90 to the left as viewed in FIG. 3 upon actuation of motor 68.

The numeral 92 refers to a spray nozzle which is operatively connected to a source of cooling liquid under pressure designed to spray a fine mist on the cutting wheel as viewed in FIG. 3 to cool the same during the florentining operation.

Figure 4:
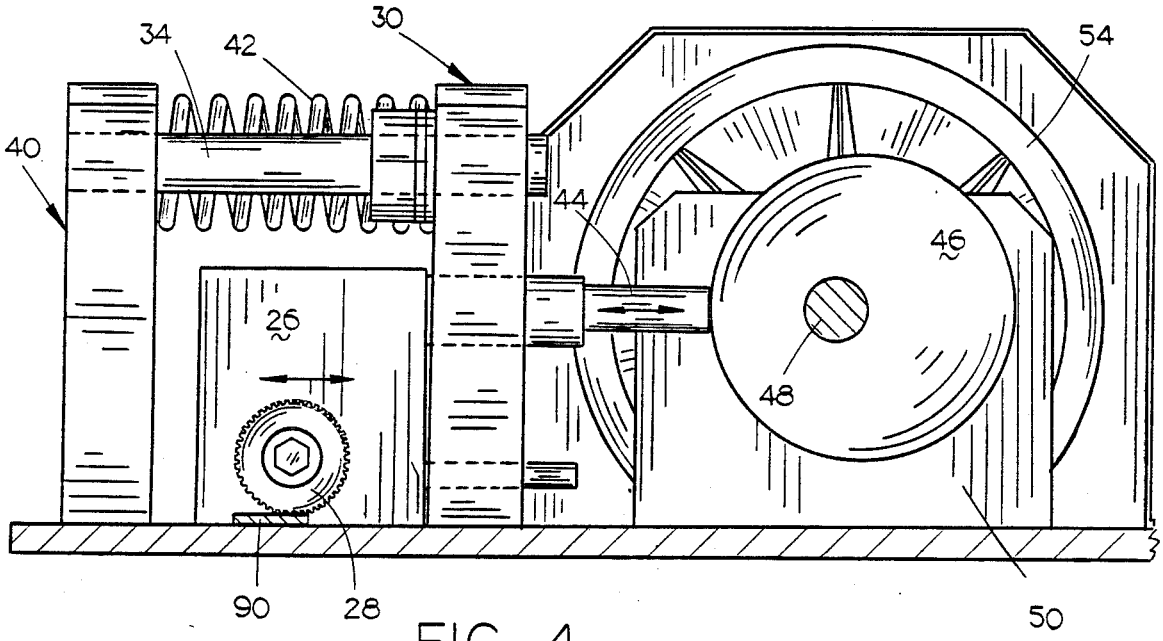
FIG. 4 is a sectional view seen on lines 4—4 of FIG. 2.
Figure 5:
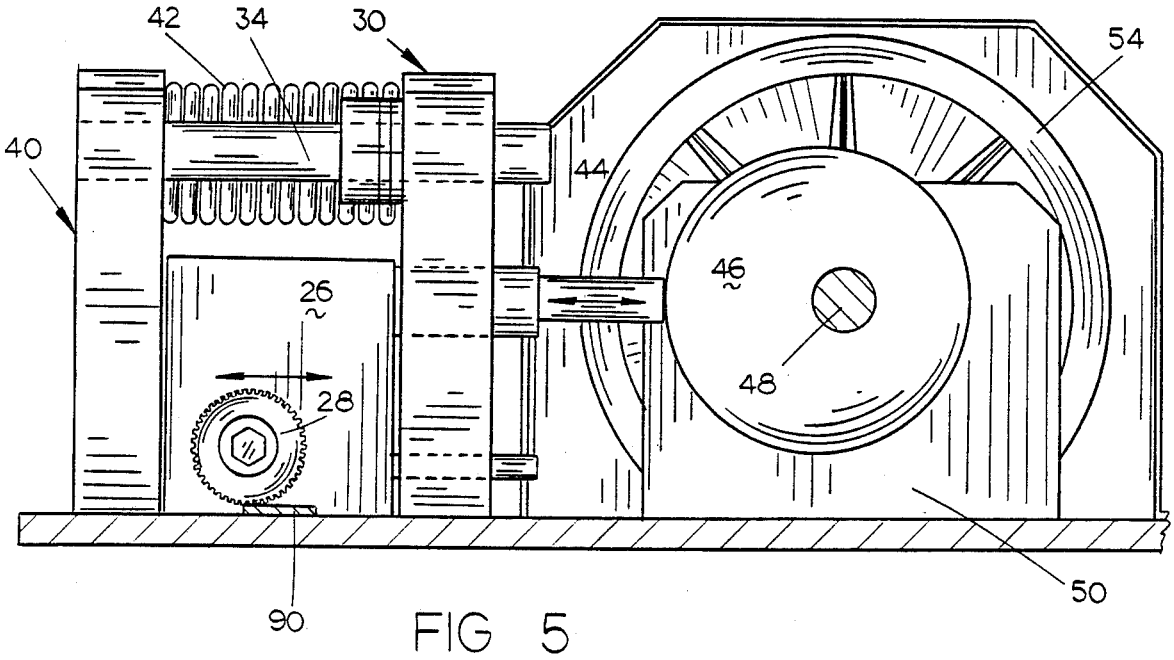
FIG. 5 is a view similar to FIG. 4 except that the cutter wheel has been moved laterally from the position of FIG. 5.

In operation, motor 16 is energized which causes the rotation of the cutter wheel 28. Motor 66 is also energized which causes pulley 54 to be rotated which in turn causes the eccentrically mounted wheel 46 to be rotated. Spring 42 urges support member 30 to the right as viewed in FIG. 4 so that dowel or pin 44 is kept in contact with the periphery of wheel 46. As wheel 46 rotates, dowel 44 is moved back and forth in a horizontal fashion which causes the cutter wheel 28 to be moved back and forth.

Figure 6:
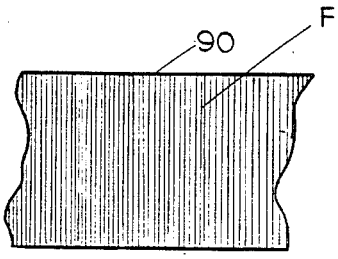
FIG. 6 is a partial plan view illustrating the gold strip after the florentine finish has been created therein.

Motor 68 is also energized and the gold strip 90 is fed between the friction or pressure wheels 80 and 88 which causes the strip 90 to be advanced to the left as viewed in FIG. 3. The strip is introduced between the friction wheels 78 and 80 and then positioned or passed beneath the cutter wheel 26. Continuous operation of the motor 68 causes the strip 90 to be continuously moved across the upper surface of table portion 12 beneath the rotating and oscillating cutter wheel. The rotation of the cutter wheel and the oscillation of the wheel back and forth as the strip moves therebelow creates the uniform-depth florentine surface on the strip referred to generally by the reference numeral F in FIG. 6. The nozzle 92 sprays a fine mist of cooling liquid onto the cutting wheel as the cutting operation is performed to prevent overheating of the cutting wheel 28.

After the strip 90 has been florentined, it is suggested that the strip be reversed and passed through the machine again so that the florentine surface is further enhanced.

After the strip has been florentined, the leaves are subsequently punched or stamped therefrom with the bright or vein cuts being formed in the leaves, as is described more completely in our co-pending patent application entitled "Apparatus for Punching Leaves from a Gold Strip," Ser. No. 5,078.

Thus it can be seen that a novel apparatus has been provided which permits a florentine or mat surface to be created on a gold strip without the necessity of manually creating the florentine finish on individual leaves. The apparatus of this invention substantially decreases the amount of labor necessary to create the florentine finish on gold strips for subsequent use in Black Hills Gold jewelry. It can therefore be seen that the invention accomplishes at least all of its stated objectives.

I claim:

1. An apparatus for creating a florentine finish on a flat metal strip for use in the manufacture of jewelry, comprising, a support means adapted to have the flat metal strip positioned thereon, means on said support means for longitudinally moving said strip with respect thereto, a first power means on said support means, including a horizontally extending power shaft, a movable florentining means operatively connected to said first power means which engages one side of said strip to create a uniform-depth florentine finish thereon as said strip is moved on said support means, said movable florentining means including a rotatable cutting wheel means on said power shaft which is positioned above the strip and which is in contact therewith, the strip being moved parallel to the longitudinal axis of rotation of said power shaft, and means for moving said cutting wheel means back and forth across the strip in a substantially transverse manner with respect to the direction of movement of the strip so as to impart a florentine finish thereon.

2. The apparatus of claim 1 wherein said means for moving said strip comprises at least one driven, rotating wheel means which frictionally engages the strip.

3. The apparatus of claim 1 wherein said means for moving said cutting wheel means back and forth comprises a powered eccentric means in operative engagement with said power shaft.

4. The apparatus of claim 1 wherein means is provided for cooling the movable florentining means.

5. The apparatus of claim 1, wherein said cutting wheel means is disk-shaped.

* * * * *